US005531085A

United States Patent [19]

Hayes

[11] Patent Number: 5,531,085

[45] Date of Patent: Jul. 2, 1996

[54] DIE LUBRICANT APPLICATOR

[76] Inventor: John W. Hayes, 1660 Highway 51 South, Hernando, Miss. 38632

[21] Appl. No.: 238,302

[22] Filed: May 5, 1994

[51] Int. Cl.[6] ..... B21B 45/02; B21B 37/08

[52] U.S. Cl. ..... 72/43; 72/20.1; 72/41; 72/39

[58] Field of Search ..... 72/21, 25, 43, 72/44, 45, 39; 184/7.4, 6.14; 251/129.15, 129.2, 129.21, 129.22; 137/883, 624.1

[56] References Cited

U.S. PATENT DOCUMENTS

| | | | |
|---|---|---|---|
| 3,561,238 | 2/1971 | Tetzloff et al. . | |
| 3,756,051 | 9/1973 | Rebsamen et al. . | |
| 3,877,271 | 4/1975 | Maddock . | |
| 3,921,111 | 11/1975 | Kowalski | 251/129.15 |
| 3,974,998 | 8/1976 | Wood | 251/129.15 |
| 4,148,203 | 4/1979 | Farazandeh et al. | 72/21 |
| 4,463,587 | 8/1984 | Werner | 72/39 |
| 4,520,643 | 6/1985 | Werner et al. . | |
| 4,759,703 | 7/1988 | Krebser et al. | 72/44 |
| 5,205,377 | 4/1993 | Pfarrwaller et al. | 184/7.4 |
| 5,293,551 | 3/1994 | Perkins et al. | 251/129.15 |

OTHER PUBLICATIONS

Franklin Oil Corporation, *F.A.S.T. Lube System* (8 page brochure, date unknown).

FlexSpray division of Metric Tool and Die Corporation, *FlexSpray Expandable Airless Spray Stock Lubrication Systems* (12 page brochure, date unknown).

A–S Mfg. Inc., *TeK–Spray, The Next Generation of Airless Spray Die Lubricant Application Systems* (two page brochure, date unknown).

Pax Products, Inc., *How to Spot a Quality In–Die Lubrication System,* Metal Forming 1993, at 9 (advertisement).

*Primary Examiner*—Lowell A. Larson
*Assistant Examiner*—Rodney A. Butler
*Attorney, Agent, or Firm*—Walker, McKenzie & Walker

[57] ABSTRACT

A die lubricant applicator for spraying lubricant from a pressurized source of lubricant through a plurality of injector nozzles onto a die press. Associated with each injector nozzle is a solenoid-operated valve for selectively gating the flow of the lubricant to the injector nozzle, and also an electronic control, such as a portion of a programmable logic controller, responsive to the movement of the die of the die press, for opening the solenoid valve for a predetermined and programmable dwell time, thereby passing a predetermined volume of lubricant from the pressurized source to the injector nozzle. The electronic control associated with each injector nozzle includes a programmable timer that causes the solenoid valve to open for the programmed dwell time, and the electronic control may also include a programmable counter that can inhibit the firing of the programmable dwell timer for a number of die press cycles. The lubricant spray from each injector nozzle may be adjusted to occur at a selected point during the die press cycle, and, if desired, different injectors may spray at different points during the die press cycle. A plurality of solenoid valves are assembled onto a manifold for metering the flow of lubricant to a plurality of injector nozzles.

18 Claims, 3 Drawing Sheets

PROCESSOR
PROGRAM DISPLAY
1234
OFF ON
POWER
PROGRAM
INJECTOR
STROKES
VOLUME

DIE LUBRICANT APPLICATOR

BACKGROUND OF THE INVENTION

1. Field of the Invention

The present invention relates, in general, to die and stamping presses and the like, and in particular, to apparatus for applying lubricant to such die and stamping presses during the stamping process.

2. Information Disclosure Statement

Die presses typically have a movable die that presses a workpiece, such as a piece of metal, between the movable die and a fixed die, so as to bend, shape, punch, stamp, and otherwise meld the metal into a finished product. So-called "progressive die" presses are well-known that sequentially perform such melding operations on workpieces. Die lubricant applicators have long been used for spraying lubricant from a pressurized source of lubricant through injector nozzles onto such die presses.

Heretofore, die lubricant applicators typically employed air-powered lubricant pumps to pump lubricant through one or more injector nozzles, and such pumps have been of the positive displacement type having reciprocating pistons driven by air pressure, as well as having check valves and springs, i.e., numerous moving parts. Such pumps are prone to failure, are unable to precisely control the application of lubricant, and require a source of air pressure to reciprocate the pistons of the pumps. Adjustment of such pumps usually requires manual turning of a screw or knob on the pump to change the stroke length of the reciprocating piston, thereby changing the lubricant volume brought into, and forced out of, the pump with each stroke of the piston. Such adjustments have the disadvantage that they cannot be performed remotely.

Additionally, prior art die lubricant applicators have the problem that there are tremendous impulses of lubricant pressure at the injector nozzles caused by the typically 9 to 1 pressure multiplication within their air-powered lubricant pump, causing the hydraulic pressure at the nozzle orifices to be multiplied by a factor of nine over the air pressure applied to the pump's piston by the air source. Such high pressure impulses at the nozzle orifices causes the lubricant to exit the nozzles at a terrific velocity and bounce (splash) when the lubricant strikes the dies and the workpiece, thereby wasting lubricant and splashing on the die press operator and the floor surrounding the die press, thereby creating a safety and environmental hazard.

Furthermore, as the workpiece moves sequentially through the die press to successive stations for bending, shaping, punching, stamping, etc., some lubricant is carried from earlier stations to later stations on the workpiece. It would be desirable to apply controlled and lesser amounts of lubricant to certain die press stations by occasionally skipping lubricant application cycles for one or more cycles of the die press.

It is therefore desirable to have an improved die lubricant applicator that precisely meters the application of die lubricant through injector nozzles and which substantially lacks the impulsive pressure spikes heretofore seen in applicator systems using air-powered lubricant pumps. Such an improved applicator should not require the use of air power at all, and should have a minimum of moving parts for increased reliability.

A preliminary patentability search in Class 72, subclasses 43 and 45, produced the following patents, some of which may be relevant to the present invention: Tetzloff et al., U.S. Pat. No. 3,561,238, issued Feb. 9, 1971; Rebsamen et al., U.S. Pat. No. 3,756,051, issued Sep. 4, 1973; Maddock, U.S. Pat. No. 3,877,271, issued Apr. 15, 1975; and Werner et al., U.S. Pat. No. 4,520,643, issued Jun. 4, 1985.

Additionally, the following other publications are known, all of which have publication dates more than one year prior to the filing of this application: Franklin Oil Corporation, *F.A.S.T. Lube System* (8 page brochure, date unknown); FlexSpray division of Metric Tool and Die Corporation, *FlexSpray Expandable Airless Spray Stock Lubrication Systems* (12 page brochure, date unknown); A–S Mfg. Inc., *TeK-Spray. The Next Generation of Airless Spray Die Lubricant Application Systems* (two page brochure, date unknown); and Pax Products, Inc., *How to Spot a Quality In-Die Lubrication System,* Metal Forming, Feb. 1993, at 9 (advertisement).

None of these patents or publications disclose or suggest the present invention.

SUMMARY OF THE INVENTION

The present invention is a die lubricant applicator for spraying lubricant from a pressurized source of lubricant through a plurality of injector nozzles onto a die press. Associated with each injector nozzle is a solenoid-operated valve for selectively gating the flow of the lubricant to the injector nozzle, and also control means, responsive to the movement of the die of the die press, for opening the solenoid valve for a predetermined and programmable dwell time, thereby passing a predetermined volume of lubricant from the pressurized source to the injector nozzle. The control means associated with each injector nozzle includes a programmable timer that causes the solenoid valve to open for the programmed dwell time, and the control means may also include a programmable counter that can inhibit the firing of the programmable dwell timer for a number of die press cycles. The lubricant spray from each injector nozzle may be adjusted to occur at a selected point during the die press cycle, and, if desired, different injectors may spray at different points during the die press cycle.

It is an object of the present invention to precisely meter the volume of die lubricant through the injector nozzles and to substantially eliminate impulsive pressure spikes in the delivery of lubricant from the nozzles. It is a further object of the present invention to apply lubricant to die presses with a minimum of moving parts that might require maintenance, and with a fewer number of such moving parts than heretofore required.

DESCRIPTION OF THE PREFERRED EMBODIMENTS

Figures 1, 2, 3:
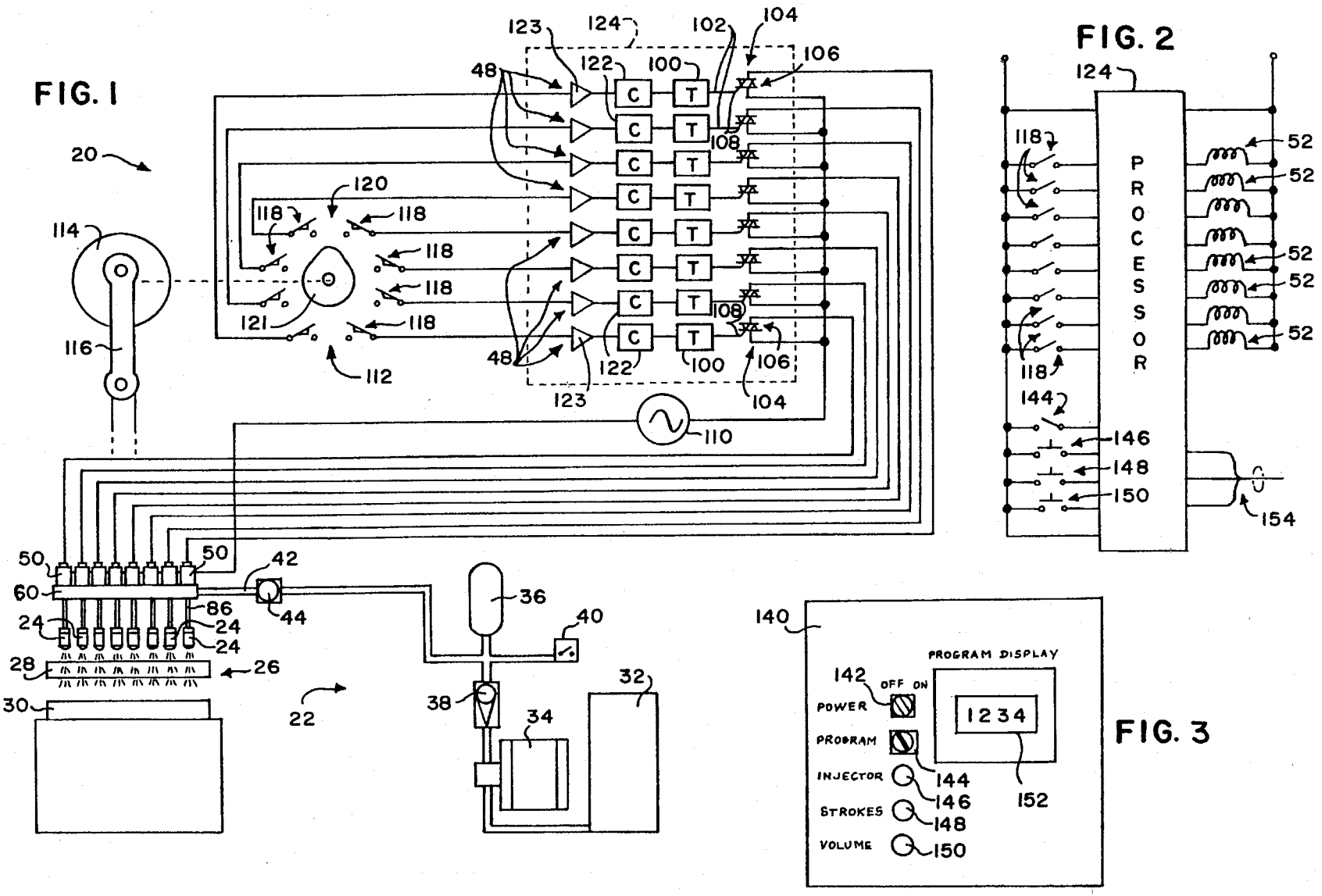
FIG. 1 is a schematic and block diagram showing the components of the present invention.
FIG. 2 is a schematic diagram showing various connections to the processing unit of the present invention.
FIG. 3 is a view of the programming panel for the processing unit.

Referring to FIGS. 1–3 and 5–7, a die lubricant applicator 20 is shown for spraying lubricant from a pressurized source 22 of lubricant through a plurality of injector nozzles 24 onto a die press 26. Well-known die press 26 has a movable die 28 that presses a workpiece, such as a piece of metal (not shown), between movable die 28 and a fixed die 30, in a manner well-known to those skilled in the art, so as to bend, shape, punch, and otherwise meld the metal into a finished product. So-called "progressive die" presses are well-known that sequentially perform such melding operations on workpieces.

Pressurized source 22 of lubricant includes a lubricant reservoir 32 connected to a motor-driven pump 34 for pumping lubricant from reservoir 32 into accumulator 36 through check valve 38, thereby pressurizing accumulator 36 with pressurized lubricant in a manner well-known to those skilled in the art. The use of a diaphragm pump has been found to be desirable for pump 34 because a diaphragm pump does not adversely break down the pumped lubricant. A suitable pump 34 for use with the present invention is the stock number 2P796 industrial-duty diaphragm pump sold by the W. W. Grainger Company, Chicago, Ill., under the trademark FLOJET as FLOJET Model No. 2130-571. Gear, vane, or impeller-style pumps have been found to be less desirable because they cause shearing of water-soluble lubricants, thereby causing loss of desired lubricating properties. If desired, an amount of water may be mixed with the lubricant within pump 34 in a manner well-known to those skilled in the art, thereby lowering lubricant costs and creating a lower-viscosity lubricant.

Pressure switch 40 is provided for sensing the pressure within accumulator 36, and causes pump 34 to cycle on and off, as required, so as to maintain the pressure within accumulator 36 above a certain threshold, in a manner well-known to those skilled in the art. Well-known hydraulic hoses or piping 42 supplies this pressurized lubricant to applicator 20.

Figure 7:
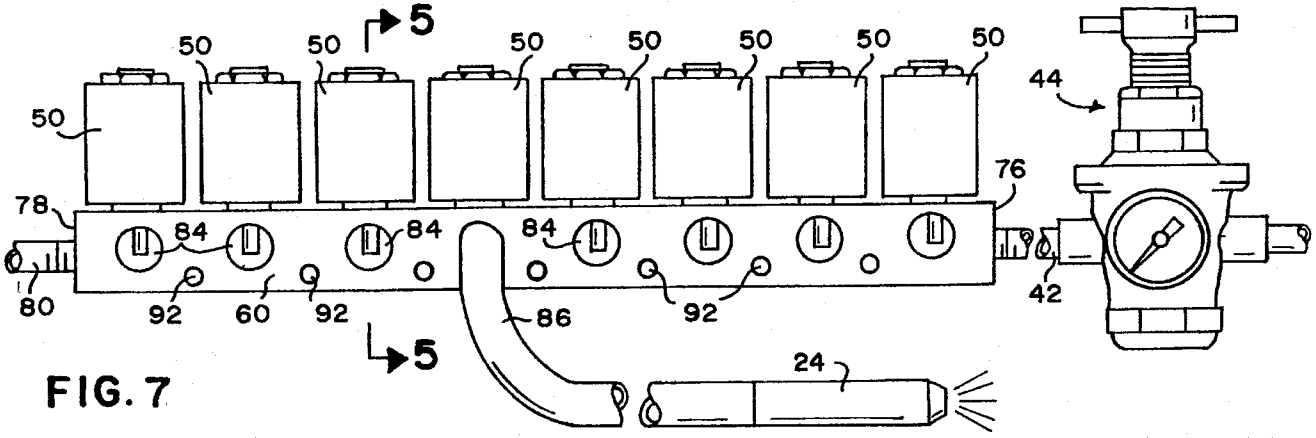
FIG. 7 is a side view of the manifold assembly of the present invention, showing interconnection to an injector nozzle and the pressurized lubricant supply means.

Pressurized source 22 of lubricant further includes a pressure regulator 44, shown in FIGS. 1 and 7, interposed within hydraulic hose 42 at the output of pressurized source 22, so as to precisely and consistently regulate the pressure of the lubricant as supplied to applicator 20. It has been found that a suitable pressure regulator for use with the present invention is a liquid petroleum gas ("LP gas") regulator such as the Model REGO 499T HP pressure regulator manufactured by Engineering Design, Elon College, N.C., allowing regulation of lubricant pressure within one pound per square inch ("PSI") of pressure from 5 to 100 PSI. It is important that accurate pressure regulation of lubricant supplied to applicator 20 be maintained so as to ensure proper injection velocity of lubricant from injector nozzles 24 and so as to ensure accurate and consistent metering of lubricant to injector nozzles 24, in a manner hereinafter described in detail. Typical desired pressures of lubricant supplied to applicator 20 are in the range of 40 to 80 PSI, although these pressures may be varied depending on the particular circumstances of lubricant application, such as, for example, the viscosity of the lubricant and other parameters.

Applicator 20 includes, respectively associated with each injector nozzle 24, metering means 46 and control means 48, hereinafter described. A description of the metering means and control means associated with any one injector nozzle 24 will suffice for all, it being understood that all metering means 46 are substantially similar and that all control means 48 are substantially similar.

Figure 5:
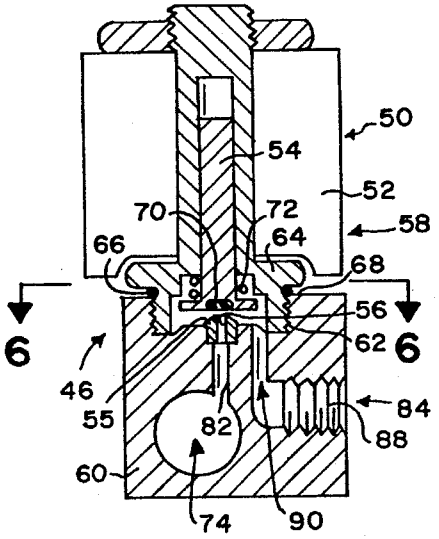
FIG. 5 is a sectional view showing the metering means and the construction of the manifold of the present invention, taken transversely through the manifold substantially along the line 5—5 shown in FIG. 7.
Figure 6:
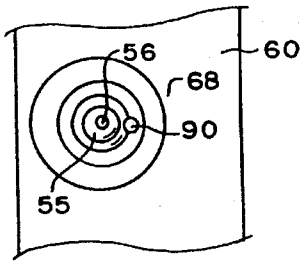
FIG. 6 is a top view of a portion of the manifold of the present invention showing the valve seat, taken substantially along the line 6—6 shown in FIG. 5.

As shown in FIGS. 5–7, applicator 20 includes metering means 46, interposed between its respective injector nozzle 24 and pressurized source 22, for selectively passing lubricant in a flow from pressurized source 22 to injector nozzle 24. Metering means 46 includes solenoid-operated valve means 50 for selectively gating the flow of lubricant to injector nozzle 24.

Preferably, valve means 50 includes a solenoid 52 surrounding a plunger 54 that reciprocates toward and away from a valve seat 55 surrounding a precisely-machined metering orifice 56, it being understood that plunger 54 reciprocates in a manner well-known to those skilled in the art in response to electrical current passing through solenoid 52. A solenoid valve assembly 58 suitable for use with the present invention is the Model No. 4000-03-4607 manufactured by Spartan Scientific, Youngstown, Ohio, having a 120 Volt AC, 8 Watt solenoid and a rating of 150 PSI. This valve assembly was chosen for its fast operation, single moving part, and high efficiency, and has been shown to reliably cycle open and closed in one millisecond.

Valve seat 55 with orifice 56 is press-fit into a manifold 60, and valve assembly 58 is threadedly received into manifold 60 as by threads 62 on a metal core 64 of valve assembly 58 that are mated with similar threads of manifold 60. A rubber "O-ring" 66 seals core 64 to manifold 60, and preferably the mating surface 68 of manifold 60 that is contacted by O-ring 66 is smoothly machined.

Plunger 54 of valve assembly 58 has a recessed rubber seal 70 that sealingly contacts valve seat 55, and a compression spring 72 forcibly urges plunger 54 toward valve seat 55, thereby sealing orifice 56 when no electrical current flows through solenoid 52.

Manifold 60 has a longitudinal inlet bore 74 therethrough, bore 74 being internally-threaded at ends 76 and 78 of manifold 60 so as to respectively receive hydraulic hose 42 from pressurized source 22 and hydraulic hose 80 to another manifold 60. It will now be understood that multiple manifolds 60 may thus be cascaded so as to accommodate a desired number of injector nozzles, each manifold having some number of valve means 50 as shown in FIG. 7. Of course, it shall be understood that the open end of bore 74 of the last such cascaded manifold 60 will be sealingly plugged, as with a bolt, so as to preserve lubricant pressure within bore 74.

Orifice 56 of valve seat 515 is seen to be in communication with inlet bore 74 as by passageway 82, thereby allowing pressurized lubricant to flow from source 22 through orifice 156 when valve seat 1515 is unsealed by actuation of solenoid 152.

Manifold 60 has a plurality of outlet ports 84, one such port 84 being connected to an associated injector nozzle 24 via a hydraulic hose 86 threadedly received into port 84 as by internal threads 88 of port 84. Each said port 84 has a passageway 90 through manifold 60 that is selectively placed in communication with inlet bore 74 via passageway 82 as solenoid 152 is actuated. Valve means 150 is thus seen to selectively gate the flow of lubricant from pressurized source 22 to injector nozzle 24. If desired, manifold 60 may also have one or more threaded blind mounting holes 92 for mounting manifold 60 to die press 26.

As shown in FIG. 1, applicator 20 further includes, respectively associated with each injector nozzle 24, control means 48, responsive to the movement of movable die 28 toward and away from fixed die 30, for causing metering means 46 to pass lubricant from pressurized source 22 to its respective injector nozzle 24 during a predetermined and programmable dwell time, thereby causing a predetermined volume of lubricant to pass from pressurized source 22 to its respective injector nozzle 24.

Control means 48 includes well-known programmable timer means 100, triggerable by the movement of movable die 28, for generating a control signal 102 that is active for the desired predetermined and programmable dwell time.

Control means 48 further includes switching means 104, such as triac 106, responsive to control signal 102 as by connecting signal 102 to the gate 108 of triac 106, for selectively applying current from an electrical power source 110 to solenoid-operated valve means 50 and causing metering means 46 to pass lubricant for the desired dwell time by causing current to flow through solenoid 52. At least one timer means 100, associated with one injector nozzle, is independently programmable for its respective dwell time relative to another such timer means 100, and preferably all timer means 100 are independently programmable as shown in FIG. 1.

Applicator 20 also includes well-known position sensing means 112 for detecting the movement of movable die 28 past a certain position in the die press cycle and for triggering each timer means 100 in response to this movement past a certain position. It shall be understood that the first preferred embodiment 20 of the applicator shown in FIG. 1 differs from the second preferred embodiment 20' shown in FIG. 4 only in the implementation of position sensing means 112, as contrasted with the position sensing means 112' of embodiment 20', hereinafter described.

As those skilled in the art will readily recognize, movable die 28 is often reciprocated toward and away from fixed die 30 by a rotating crankshaft 114 operably connected to die 28 by a connecting rod 116. The position sensing means 112 of the first embodiment includes one or more switches 118 actuated by camming means 120, such as, for example, cam 121, responsive to the movement of die 28 as by being geared to or mounted upon crankshaft 114 for simultaneous rotation therewith. In this manner, each switch 118 will be understood to be actuated as die 28 moves past a certain position in the die press cycle. Although only a single cam 121 is shown in FIG. 1 for clarity, it will be understood that independent cams may be employed for each switch 118 in a manner well-known to those skilled in the art, thereby allowing the position sensing means to detect the movement of die 28 past a plurality of certain positions. Of course, if it is desired to trigger all timer means 100 at the same position in the die press cycle, only a single switch 118 need be used to trigger all timer means 100, with a necessary loss in configuration flexibility. It has been found that such independent triggering positions of each timer means 100 in the die press cycle is desirable because the optimum spraying instant in the die press cycle for one injector nozzle may not necessarily be the optimum spraying instant for another injector nozzle. For example, it may be desirable to spray lubricant from some injector nozzles just as the movable die begins its downward movement. It may be desirable to spray lubricant from other injector nozzles as the die just approaches the workpiece. And, in some cases, it may be desirable to spray lubricant from some still other injector nozzles as the die moves upwardly and the workpiece is transferred from one die press station to the next. The flexibility of the present invention accommodates all of these requirements.

Most die presses already have some sort of limit switch or camming means for sensing the movement of the movable die in order to control the operation of the press. In such cases, it may be possible to utilize unused cam switches on the die press for the position sensing means 112 of the present invention. If not, a rotary cam apparatus can be easily attached to the die press as position sensing means 112 for sensing the movement of die 28. A suitable such rotary cam apparatus is the Model RC310A rotary cam switch sold by Gemco Prod., 1080 N. Crooks Rd., Clawson, Mich. 48017.

As the workpiece moves sequentially through the die press to successive stations for bending, shaping, punching, stamping, etc., some lubricant is carried from earlier stations to later stations on the workpiece. In order to apply controlled and lesser amounts of lubricant to certain die press stations, it is desirable to provide means for occasionally skipping lubricant application cycles for one or more cycles of the die press. Therefore, each control means 48 may include well-known programmable counter means 122, responsive to position sensing means 112, for counting of the occurrences of said movement of die 28 past a certain position and for inhibiting, in a manner well-known to those skilled in the art, the triggering of its respective timer means 100 for a predetermined number of counts of said occurrences. If, as preferred and previously described, position sensing means 112 detects movement of die 28 past a plurality of certain positions, then each counter means 122 may independently count occurrences of movement of die 28 past a different one of said plurality of certain positions, allowing greater flexibility as before in the choice of where in the die press cycle to spray lubricant from each injector nozzle 24. In the first embodiment 20 of the applicator shown in FIG. 1, each counter means 122 counts occurrences of movement of die 28 past a certain location by counting the actuations of its respective switch 118.

At least one counter means 122, associated with one injector nozzle 24, is independently programmable for its respective predetermined number of counts with respect to another such counter means 122, and preferably all counter means 122 are independently programmable relative to each other as shown in FIG. 1. Each counter means 122 may also have a well-known input sensor buffer 123 with hysteresis and/or noise filters for ensuring accurate sensing of switches 118 in an industrial environment.

For modularity, a number of such control means may be packaged in a single processor module 124 as shown in FIGS. 1 and 2, and may be preferably implemented by a well-known Programmable Logic Controller ("PLC") whose timing increments and output reset times are fast enough, or have been suitably modified to be fast enough, to support the rapid times required by the present invention. One such PLC suitable for use with the present invention is the industrial processing module model number IPMIP1612-BU-II manufactured by International Parallel Machines, Bedford, Mass., having a 2 millisecond output reset response time and a 1 millisecond process timing increment, thereby giving improved injection metering control required by the present invention.

Figure 4:
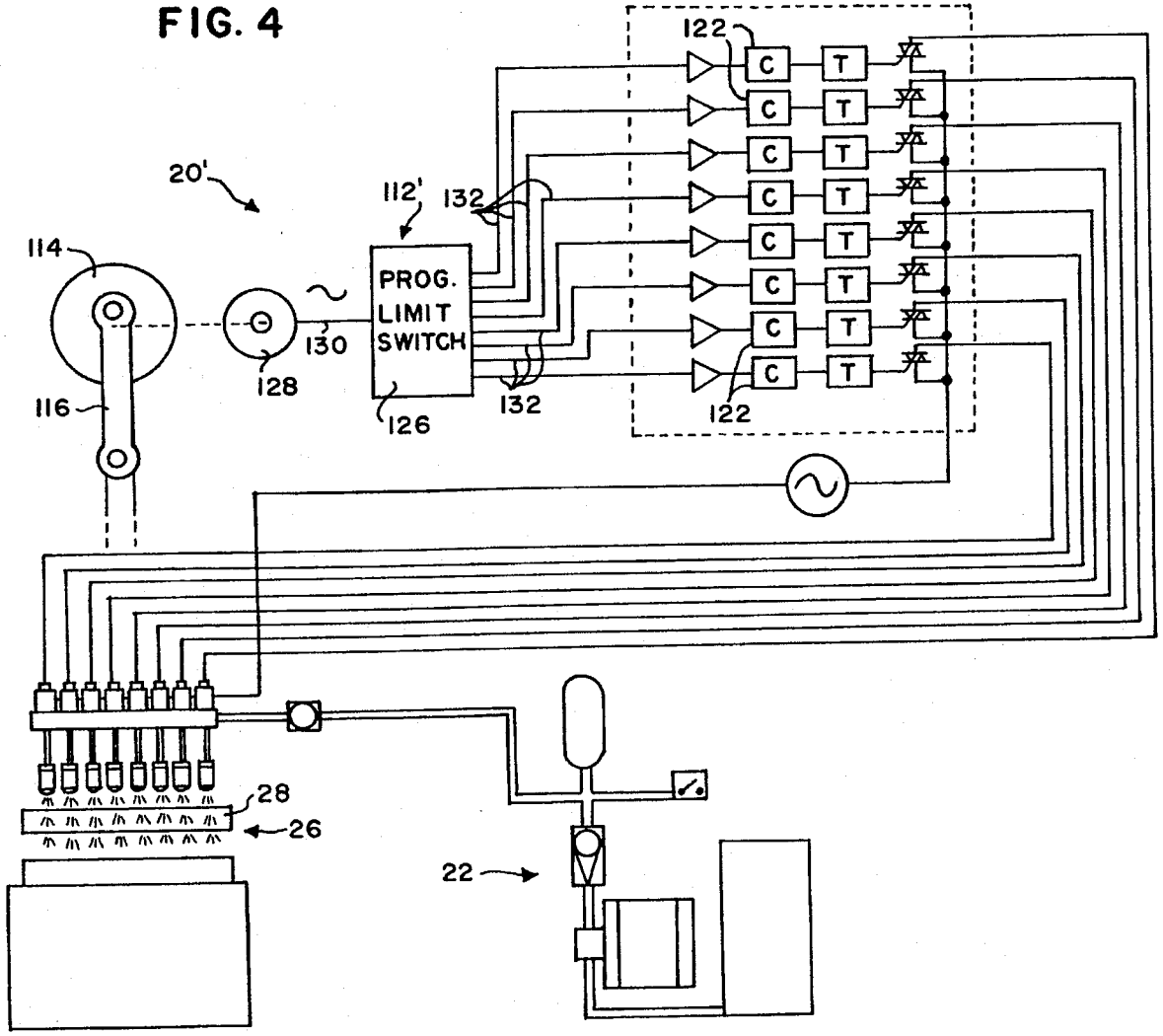
FIG. 4 is a schematic and block diagram of a second embodiment of the present invention, having a different die press position sensing means from the first embodiment.

The second preferred embodiment 20' of the applicator shown in FIG. 4 differs only in the implementation of position sensing means 112'. In this second embodiment, camming means 120 is replaced by a well-known electronic cam switch ("Programmable Limit Switch") 126 employing an input resolver (position transducer) means 128, operably coupled to rotating crankshaft 114, for generating an encoded position signal 130 in response to the motion of movable die 28. Programmable limit switch 126 is responsive to encoded position signal 130 and generates a plurality of event output signals 132 as movable die 28 moves past a certain position or past a plurality of independently-chosen certain positions, one for each event signal 132. Programmable limit switch 126 allows various programmed set points to determine the angular position of crankshaft 114 at which the corresponding event output signal 132 is activated, thereby allowing position sensing means 112' to sense the movement of die 28 in a similar manner as in the first embodiment, except that the position sensing means 112' of the second embodiment is somewhat more flexible and more easily configurable. A suitable Programmable Limit Switch and compatible Resolver are sold under the trademark MINI-CAM by the Autotech Controls Corp., 343 St. Paul Blvd., Carol Stream, Ill. 60188, as Model Nos. PLSM1020-010 (Programmable Limit Switch) and RL-100 (Resolver). In this second embodiment, each respective counter means 122 counts occurrences of the movement of movable die past a certain position by counting occurrences of its respective event signal 132. Otherwise, operation of the second embodiment is similar to that of the first embodiment.

Referring to FIGS. 5 and 6, the inner diameter of orifice 56 determines the volume of lubricant that is passed through orifice 156 under constant pressure from source 22 during the dwell time interval when valve means 150 allows lubricant to flow therethrough. When solenoid valve means 150 is energized, the constant lubricant pressure supplied by source 22 against the fixed and known inner diameter of orifice 156 for a given dwell time causes a precise amount of lubricant to be metered to the associated injector nozzle. In the present lubricant system, like any carefully regulated hydraulic system, it is important to maintain a "back pressure" within the lubricant system from injector nozzles 24 to inlet bore 74 of manifold 60. Therefore, the inner diameter of injector nozzles 24, through which lubricant flows, must be no larger than, and preferably smaller than, the inner diameter of orifice 156 so as to maintain a back pressure of lubricant from orifice 156 to injector nozzle 24 and thereby ensure a smooth and non-impulsive flow of lubricant out of injector nozzle 24. An inner diameter of 0.095 inches (2.4 mm) has been found acceptable as an inner diameter for orifice 56 with the injection dwell times herein described in detail.

Because solenoid valves 150 are preferably powered by an alternating current ("AC") source 110 as selectively applied to solenoid valves 150 by triacs 106, it will be understood by those skilled in the art that there will be a slight "dead band" control delay concurrent with zero crossings of the voltage from AC source 110 during which the AC voltage applied to the solenoid valves will not be sufficient to energize the valves when the voltage is first applied. For 60 cycle sources, having zero voltage crossings approximately every 8 milliseconds, this dead band has been experimentally determined to be approximately one to two milliseconds with the solenoid valves used with the present invention, thereby limiting the repeatable minimum dwell times that are reliably achievable to approximately two milliseconds, significantly faster and more precise than that achievable with prior art air-powered pumps. It will thus be understood that the dwell time must be sufficiently long and at least as long as this repeatable minimum dwell time so as to overlap enough of the AC voltage sine wave to energize its solenoid valve 50. This dead band delay could be reduced if faster AC sources were to be used, but the mechanical response time of the solenoid valves then becomes a limiting factor to shorter dwell times.

Referring to FIG. 2 showing a block diagram schematic of various connections to processor 124, and also to FIG. 3 showing a front view of the operator's panel 140 for processor 124, the setup and programming of processor 124 can now be explained.

Operator's panel 140 has a key-operated on-off switch 142, a key-operated programming mode switch 144, pushbuttons 146, 148, and 150 respectively for programming an injector, the stroke count for that injector, and the volume dwell time for that injector. Program display 152 is a four-digit display, with its leftmost digit showing the chosen injector, the next digit showing the programmed stroke count for that injector, and the rightmost two digits showing the dwell time, in milliseconds, that is programmed into the respective timer means.

To program processor 124, programming mode keyswitch 144 must be enabled, thereby controlling access to the operational parameters of processor 124. Once enabled, buttons 146, 148, and 150 will become enabled.

Depressing injector pushbutton 146 causes the leftmost digit in program display 1 152 to increment, indicating that programming parameters for a selected injector nozzle may be modified.

Depressing stroke count pushbutton 148 causes the second digit of display 152 to increment and indicate the stroke count that is then automatically loaded into the counter means associated with the selected injector nozzle, thereby causing the triggering of the timer means for that selected injector nozzle to be inhibited for various selected counts of occurrences of movement of die 28 past a certain position, as heretofore described in detail. For example, if the stroke count is set to 1, then the timer associated with the chosen injector nozzle will never be inhibited, and will be triggered on every detection of movement of die 28 past a certain position. Likewise, if the stroke count is set to 9, then the respective timer will only be triggered every ninth occurrence of movement of die 28 past a certain position. In this manner, die press cycles can be skipped to accommodate the carry over of lubricant from one die station to the next by the workpiece.

Depressing volume dwell time pushbutton 150 causes the rightmost two digits of display 152 to increment and display a dwell time, in milliseconds, that will be loaded into the timer means associated with the selected injector nozzle. For ease of programming, holding the volume dwell time pushbutton depressed will cause the rightmost two digits to repeatedly increment while the button is depressed. As longer dwell times are programmably loaded into the timer means associated with a given injector nozzle, valve means 50 will stay open for longer periods. The amount of lubricant that is sprayed from the injector nozzle 24 during each firing of its associated timer means 100 is thus precisely metered as a result of the constant lubricant pressure gated by valve means 50 through the precisely-machined orifice 56 in valve seat 55, for a time equal to the dwell time count loaded into the timer means 100.

A larger display having a greater number of digits can also be used, if desired, allowing larger parameters to be specified for each of the programmable counters and timers, etc.

Experiments have shown that typical required dwell times for the orifice size given and the 40 to 80 PSI pressure supplied by source 22 are in the range of 2 to 99 milliseconds. However, for extremely viscous lubricants, which require longer dwell times due to the sluggish movement of such lubricants within the hydraulic lines, dwell times as long as 200 milliseconds or so may be necessary.

For central and automatic programming and setup of processor 124, an RS-485 serial communications interface 154 may be provided in a manner well-known to those skilled in the art for downloading the programming parameters into processor 124 from a central computer (not shown), and for remotely interrogating processor 124. In such a manner, all the parameters for a particular die press machine, including those for the die lubricant applicator, can be easily and quickly set from a central location as various job lots are processed.

Figure 8:
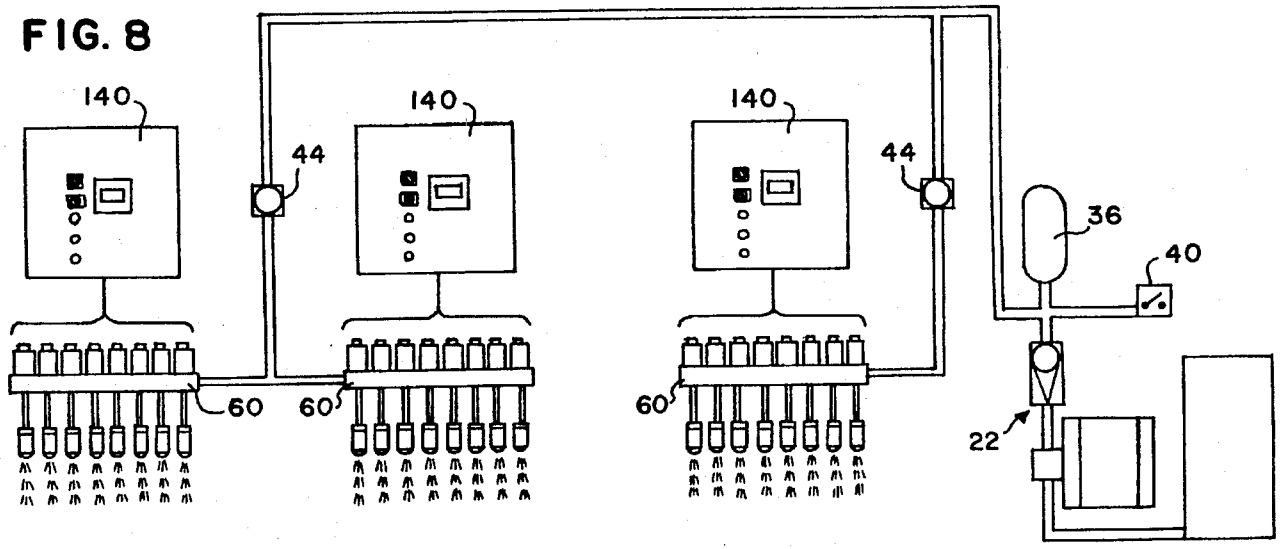
FIG. 8 is a block diagram showing the present invention configured for multiple die presses.

As shown in the block diagram of FIG. 8, multiple die lubricant applicators for multiple die presses may be supplied from a common pressurized source 22 of lubricant, each die lubricant applicator having its own processor module with associated operator's panel 140. All applicators may be remotely programmed from a central location for convenience, as previously described.

Referring to FIGS. 1 and 2, it should also be noted that, because each control means within processor 124 has an independent input received from a position sensing means and an independent output connectable to a solenoid valve, it is possible to use one processor 124 to control applicators on multiple die presses and to use a single manifold for solenoid valves that control injector nozzles on the multiple die presses. The grouping of several solenoid valves for a single die press on a single manifold 60, and the grouping of several control means 48 for a single die press within a single processor 124 has been shown throughout for purposes of clarity and ease of understanding.

Although the present invention has been described and illustrated with respect to preferred embodiments and a preferred use therefor, it is not to be so limited since modifications and changes can be made therein which are within the full intended scope of the invention.

I claim:

1. A die lubricant applicator for spraying lubricant from a pressurized source of said lubricant through a plurality of injector nozzles onto a die press, said die press having a movable die, said applicator comprising, respectively associated with each said injector nozzle:

(a) metering means, interposed between its respective said injector nozzle and said pressurized source, for selectively passing said lubricant in a flow from said pressurized source to its respective said injector nozzle, said metering means including solenoid-operated valve means for selectively gating the flow of said lubricant to its respective said injector nozzle; said solenoid-operated valve means having an orifice through which said lubricant is allowed to selectively flow from said pressurized source to said respective said injector nozzle and said solenoid-operated valve means including a moving plunger, said plunger being movable between a first open position in which said orifice is not sealed by said plunger and a second closed position in which said orifice is directly .sealed by said plunger; and (b) control means, responsive to the movement of said movable die, for causing said metering means to pass said lubricant from said pressurized source to its respective said injector nozzle during a predetermined and programmable dwell time, thereby causing a predetermined volume of said lubricant to pass from said pressurized source to its respective said injector nozzle; said control means including:

i. programmable timer means, triggerable by the movement of said movable die, for generating a control signal active for said dwell time; and ii. switching means, responsive to said control signal, for selectively applying current from an electrical power source to said solenoid-operated valve means and causing said metering means to pass said lubricant for said dwell time, at least one said programmable timer means, associated with one said injector nozzle, being independently programmable for its respective said dwell time relative to another said programmable timer means associated with another said injector nozzle.

2. The applicator as recited in claim 1, in which said applicator includes position sensing means for detecting the movement of said movable die past a plurality of certain positions and for triggering each said timer means in response to said movement past said certain positions, each said timer means being respectively triggered at an independently-chosen one of said plurality of certain positions with at least one of said independently-chosen one of said plurality of certain positions being different from another of said independently-chosen one of said plurality of said plurality of certain positions.

3. The applicator as recited in claim 1, in which said applicator includes position sensing means for detecting the movement of said movable die past a certain position and for triggering each said timer means in response to said movement past said certain position.

4. The applicator as recited in claim 3, in which each said control means associated with its respective said injector nozzle further includes programmable counter means, responsive to said position sensing means, for counting of the occurrences of said movement of said movable die past said certain position and for inhibiting the triggering of its respective said timer means for a predetermined number of counts of said occurrences, and in which at least one said counter means, associated with said one said injector nozzle, has an independently programmable said predetermined number of counts relative to said another said counter means associated with another said injector nozzle.

5. The applicator as recited in claim 4, in which said position sensing means includes:

(a) a switch operably connected to each said counter means; and (b) camming means, responsive to the movement of said movable die, for actuating said switch as said movable die moves past said certain position, and in which each said counter means counts said occurrences of said movement by counting the actuations of said switch.

6. The applicator as recited in claim 4, in which said position sensing means includes:

(a) resolver means for generating an encoded position signal in response to the motion of said movable die; and (b) programmable limit switch means, responsive to said encoded position signal, for generating an event signal as said movable die moves past said certain position, and in which each said counter means counts said occurrences of said movement by counting the occurrences of said event signal.

7. The applicator as recited in claim 2, in which each said control means associated with its respective said injector nozzle further includes programmable counter means, responsive to said position sensing means, for counting of the occurrences of said movement of said movable die past said independently-chosen one of said plurality of certain positions and for inhibiting the triggering of its respective said timer means for a predetermined number of counts of said occurrences.

8. The applicator as recited in claim 7, in which said position sensing means includes:

(a) a switch operably connected to each said counter means; and (b) camming means, responsive to the movement of said movable die, for actuating said switch as said movable die moves past said certain position, and in which each said counter means counts said occurrences of said movement by counting the actuations of said switch.

9. The applicator as recited in claim 7, in which said position sensing means includes:

(a) resolver means for generating an encoded position signal in response to the motion of said movable die; and (b) programmable limit switch means, responsive to said encoded position signal, for generating an event signal as said movable die moves past said certain position, and in which each said counter means counts said occurrences of said movement by counting the occurrences of said event signal.

10. In combination, (a) a die press having a movable die;

(b) a plurality of injector nozzles oriented so as to spray onto said die press; and (c) a die lubricant applicator for spraying lubricant from a pressurized source of said lubricant through said plurality of injector nozzles onto said die press, said applicator comprising, respectively associated with each said injector nozzle:

i. metering means, interposed between its respective said injector nozzle and said pressurized source, for selectively passing said lubricant in a How from said pressurized source to its respective said injector nozzle, said metering means including solenoid-operated valve means for selectively gating the flow of said lubricant to its respective said injector nozzle; said solenoid-operated valve means having an orifice through which said lubricant is allowed to selectively flow from said pressurized source to said respective said injector nozzle and said solenoid-operated valve means including a moving plunger, said plunger being movable between a first open position in which said orifice is not sealed by said plunger and a second closed position in which said orifice is directly sealed by said plunger; and ii. control means, responsive to the movement of said movable die, for causing said metering means to pass said lubricant from said pressurized source to its respective said injector nozzle during a predetermined and programmable dwell time, thereby causing a predetermined volume of said lubricant to pass from said pressurized source to its respective said injector nozzle; said control means including:

A. programmable timer means, triggerable by the movement of said movable die, for generating a control signal active for said dwell time; and B. switching means, responsive to said control signal, for selectively applying current from an electrical power source to said solenoid-operated valve means and causing said metering means to pass said lubricant for said dwell time;

at least one said programmable timer means, associated with one said injector nozzle, being independently programmable for its respective said dwell time relative to another said programmable timer means associated with another said injector nozzle.

11. The applicator as recited in claim 10, in which said applicator includes position sensing means for detecting the movement of said movable die past a plurality of certain positions and for triggering each said timer means in response to said movement past said certain positions, each said timer means being respectively triggered at an independently-chosen one of said plurality of certain positions with at least one of said independently-chosen one of said plurality of certain positions being different from another of said independently-chosen one of said plurality of said plurality of certain positions.

12. The applicator as recited in claim 10, in which said applicator includes position sensing means for detecting the movement of said movable die past a certain position and for triggering each said timer means in response to said movement past said certain position.

13. The applicator as recited in claim 12, in which each said control means associated with its respective said injector nozzle further includes programmable counter means, responsive to said position sensing means, for counting of the occurrences of said movement of said movable die past said certain position and for inhibiting the triggering of its respective said timer means for a predetermined number of counts of said occurrences, and in which at least one said counter means, associated with said one said injector nozzle, has an independently programmable said predetermined number of counts relative to said another said counter means associated with another said injector nozzle.

14. The applicator as recited in claim 13, in which said position sensing means includes:

(a) a switch operably connected to each said counter means; and (b) camming means, responsive to the movement of said movable die, for actuating said switch as said movable die moves past said certain position, and in which each said counter means counts said occurrences of said movement by counting the actuations of said switch.

15. The applicator as recited in claim 13, in which said position sensing means includes:

(a) resolver means for generating an encoded position signal in response to the motion of said movable die; and (b) programmable limit switch means, responsive to said encoded position signal, for generating an event signal as said movable die moves past said certain position, and in which each said counter means counts said occurrences of said movement by counting the occurrences of said event signal.

16. The applicator as recited in claim 11, in which each said control means associated with its respective said injector nozzle further includes programmable counter means, responsive to said position sensing means, for counting of the occurrences of said movement of said movable die past said independently-chosen one of said plurality of certain positions and for inhibiting the triggering of its respective said timer means for a predetermined number of counts of said occurrences.

17. The applicator as recited in claim 16, in which said position sensing means includes:

(a) a switch operably connected to each said counter means; and (b) camming means, responsive to the movement of said movable die, for actuating said switch as said movable die moves past said certain position, and in which each said counter means counts said occurrences of said movement by counting the actuations of said switch.

18. The applicator as recited in claim 16, in which said position sensing means includes:

(a) resolver means for generating an encoded position signal in response to the motion of said movable die; and (b) programmable limit switch means, responsive to said encoded position signal, for generating an event signal as said movable die moves past said certain position, and in which each said counter means counts said occurrences of said movement by counting the occurrences of said event signal.

* * * * *